US006469425B1

(12) United States Patent
Sakai et al.

(10) Patent No.: US 6,469,425 B1
(45) Date of Patent: Oct. 22, 2002

(54) ELECTRON EMISSION FILM AND FIELD EMISSION COLD CATHODE DEVICE

(75) Inventors: Tadashi Sakai, Yokohama; Kazuya Nakayama, Sagamihara; Li Zhang, Tokyo, all of (JP); Gehan Anil Joseph Amaratunga, Cambridge (GB); Ioannis Alexandrou, Liverpool (GB); Mark Baxendale; Nalin Rupasinghe, both of Cambridge (GB)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/501,241

(22) Filed: Feb. 10, 2000

(30) Foreign Application Priority Data

Feb. 12, 1999 (GB) ..... 9903302

(51) Int. Cl.[7] ..... H01J 1/30

(52) U.S. Cl. ..... 313/310; 313/309

(58) Field of Search ..... 313/310, 311, 313/309, 495, 326, 336, 346 R, 351; 445/24, 38, 50, 51

(56) References Cited

U.S. PATENT DOCUMENTS

| | | | | | |
|---|---|---|---|---|---|
| 5,777,427 | A | * | 7/1998 | Tanaka et al. | 313/309 |
| 5,847,495 | A | * | 12/1998 | Yamanobe et al. | 313/310 |
| 5,902,838 | A | * | 5/1999 | Woods et al. | 522/113 |
| 6,023,124 | A | * | 2/2000 | Chuman et al. | 313/310 |
| 6,097,138 | A | * | 8/2000 | Nakamoto | 313/309 |
| 6,146,227 | A | * | 11/2000 | Mancevski | 445/24 |
| 6,213,834 | B1 | * | 4/2001 | Ohnishi et al. | 445/6 |
| 6,270,398 | B1 | * | 8/2001 | Kobayashi et al. | 445/24 |
| 6,334,803 | B1 | * | 1/2002 | Shibata | 445/51 |
| 6,184,610 | B1 | * | 2/2002 | Shibata et al. | 313/309 |
| 6,184,612 | B1 | * | 2/2002 | Negishi et al. | 313/310 |

* cited by examiner

*Primary Examiner*—Sandra O'Shea
*Assistant Examiner*—Anabel Ton
(74) *Attorney, Agent, or Firm*—Oblon, Spivak, McClelland, Maier & Neustadt, P.C.

(57) ABSTRACT

An electron emission film includes a matrix consisting essentially of amorphous carbon and fullerene-like structures consisting essentially of a two-dimensional network of six-membered carbon rings. The fullerene-like structures are dispersed in the matrix and partially project from the matrix. The weight ratio of amorphous carbon to the fullerene-like structures is about 50:50 to 5:95. Amorphous carbon contains nitrogen acting as a donor at a concentration of about $4\times10^{-7}$ to 10 atom %.

14 Claims, 8 Drawing Sheets

ELECTRON EMISSION FILM AND FIELD EMISSION COLD CATHODE DEVICE

BACKGROUND OF THE INVENTION

The present invention relates to an electron emission film, a field emission cold cathode device using the electron emission film, and methods of manufacturing the same.

A micro cold cathode device of field emission type has an emitter and a gate electrode (and/or an anode electrode). When a voltage is applied across the emitter and the electrode, the emitter emits electrons. Cold cathode devices of this type have advantages such as a high response speed, radiation resistance, heat resistance, and high power, and extensive studies have been made therefor. For example, as disclosed in Jpn. Pat. Appln. KOKAI Publication No. 10-149778 (Jun. 2, 1998) (U.S. Ser. No. 08/931,417; Sep. 16, 1997) filed by some of the present inventors, a cold cathode device is expected as a high-power/high-voltage switching device.

From the viewpoint of electron emission at a low electric field and stable high power emission, carbon-based materials have received a great deal of attention as emitter materials. Conventionally, diamond, graphite, amorphous carbon, and the like have been proposed as carbon-based materials for an emitter.

Low-electric-field electron emission characteristics of several V/$\mu$m or less have been reported.

For example, low-electric-field electron emission by an amorphous carbon film formed on an Si substrate by the cathode arc method is disclosed in APL 68 (18), p. 2529, (1996) by some of the present inventors (G. A. J. Amaratunga et al.). This reference also discloses that nitrogen-doped amorphous carbon lowers the electron emission threshold field. Such a low electric field is found not only in an nitrogen-doped amorphous carbon film (a-C:N), which is prepared by the cathode arc method but also in a hydrogenated amorphous carbon film (a-C:N:H) prepared by plasma CVD.

Jpn. Pat. Appln. KOKAI Publication No. 10-149760 (Jun. 2, 1998) (U.S. Ser. No. 08/933,039; Sep. 18, 1997) filed by Masayuki Nakamura discloses a cold cathode device that has carbon nanotubes or fullerenes on an emitter. Jpn. Pat. Appln. KOKAI Publication No. 10-112253 (Apr. 28, 1998) filed by Bernard Cole discloses a cold cathode device which uses a film with a graphite structure formed by the cathode arc method as an electron emission film.

BRIEF SUMMARY OF THE INVENTION

It is an object of the present invention to provide an electron emission film having more excellent characteristics of, e.g., electron emission, mechanical strength, and fabrication, than those of the above prior arts, a field emission cold cathode device using the electron emission film, and methods of manufacturing the same.

According to a first aspect of the present invention, there is provided an electron emission film comprising:

- a first portion which consists essentially of amorphous carbon and forms a matrix; and
- a second portion having a crystal structure which consists essentially of a two-dimensional network of six-membered carbon rings that are dispersed in the matrix and partially project from the matrix,
  - wherein a weight ratio of the first portion to the second portion is about 50:50 to 5:95, and the first portion contains an impurity acting as a donor.

According to a second aspect of the present invention, in the film of the first aspect, the impurity is contained at a concentration of about $4\times10^{-7}$ to 10 atom %.

According to a third aspect of the present invention, in the film of the first or second aspect, the impurity is nitrogen.

According to a fourth aspect of the present invention, there is provided a method of manufacturing the electron emission film of the third aspect, using a film forming apparatus,

- the film forming apparatus comprising
  - a vacuum chamber for accommodating a substrate to be processed,
  - a carbon electrode and a counter electrode which are placed in the vacuum chamber to oppose each other,
  - a power supply for applying an AC power having a low frequency between the electrodes, and
  - a supply port for supplying nitrogen to an area near the carbon electrode, and
  - the method comprising:
    - a preparation step of placing the substrate in the vacuum chamber and setting the vacuum chamber to a vacuum; and
    - a film forming step of supplying nitrogen from the supply port and applying the AC power between the electrodes, to generate arc discharge and sublimate carbon from the carbon electrode, thereby depositing the electron emission film on the substrate.

According to a fifth aspect of the present invention, in the method of the fourth aspect, the frequency of the AC power is set to be about 10 to 500 Hz, in the film forming step. In place of the AC power, a DC power may be used such that it is applied as pulses with the frequency described above.

According to a sixth aspect of the present invention, in the method of the fourth or fifth aspect, the vacuum chamber is evacuated from an exhaust port located to be closer to the substrate than the counter electrode, in the film forming step.

According to a seventh aspect of the present invention, in the method of any one of the fourth to sixth aspects, a pressure on the substrate is set to be about $1\times10^{-4}$ to $1\times10^{-1}$ mbar.

According to an eighth aspect of the present invention, in the method of any one of the fourth to seventh aspects further comprises, after the film forming step, a step of etching a surface of the electron emission film using an etchant for preferentially etching the first portion relative to the second portion.

According to a ninth aspect of the present invention, in the method of the eighth aspect, the etchant is a solution containing hydrofluoric acid.

According to a 10th aspect of the present invention, there is provided a field emission cold cathode device comprising:

- a support substrate;
- an emitter arranged on the support substrate, the emitter having an electron emission surface formed of an electron emission film; and
- an extraction electrode for extracting electrons from the emitter,
- wherein the electron emission film comprises
  - a first portion which consists essentially of amorphous carbon and forms a matrix, and
  - a second portion having a crystal structure which consists essentially of a two-dimensional network of six-membered carbon rings that are dispersed in the matrix and partially project from the matrix,
    - wherein a weight ratio of the first portion to the second portion is about 50:50 to 5:95, and the first portion contains an impurity acting as a donor.

According to a 11th aspect of the present invention, in the device of the 10th aspect, the impurity is contained at a concentration of about $4\times10^{-7}$ to 10 atom %.

According to a 12th aspect of the present invention, in the device of the 10th or 11th aspect, the extraction electrode is formed of a gate electrode supported by the support substrate via a gate insulating film and opposing the emitter, and the gate insulating film consists essentially of silicon oxide.

According to a 13th aspect of the present invention, there is provided a method of manufacturing the field emission cold cathode device of the 12th aspect, comprising the steps of:

forming a multilayered structure having the support substrate, the electron emission film, a silicon oxide film to be the gate insulating film, and a conductive film to be the gate electrode, stacked in this order;

partially removing the conductive film in correspondence with the emitter to expose a selected portion of the silicon oxide film; and etching the selected portion of the silicon oxide film using an etchant to expose the electron emission surface of the emitter and simultaneously etching the electron emission surface using the etchant, the etchant preferentially etching the first portion relative to the second portion of the electron emission film.

According to a 14th aspect of the present invention, in the method of the 13th aspect, the etchant is a solution containing hydrofluoric acid.

In this specification, a fullerene or a fullerene-like structure is defined as follows.

As described in many references, a fullerene has a spherical or tubular structure having, as a shell, a two-dimensional network of five-, six-, and seven-membered carbon rings, which mainly contains six-membered carbon rings, i.e., a graphite sheet. FIG. 4A is a view showing a nanotube as one such fullerene. There is also a structure shown in FIGS. 4B or 4C in which a plurality of fullerenes form concentric circles or a helix. These structures are called superfullerenes. A fullerene-like structure means a microstructure of a crystal formed from fullerenes or superfullerenes, or sheets or walls as part of fullerenes or superfullerenes, i.e., a two-dimensional network of carbon atoms mainly containing six-membered carbon rings.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate rate presently preferred embodiments of the invention, and together with the general description given above and the detailed description of the preferred embodiments given below, serve to explain the principles of the invention.

DETAILED DESCRIPTION OF THE INVENTION

In developing the present invention, the present inventors have conducted various experiments associated with carbon-based materials usable as an emitter material for a field emission cold cathode device and obtained the following findings.

First, the amorphous carbon film disclosed in the above reference APL 68 (18), p. 2529, (1996) and, more particularly, a film of this type containing an impurity such as nitrogen has no sufficient chemical resistance required for the cold cathode device manufacturing process. More specifically, in manufacturing a cold cathode device having a gate, an $SiO_2$ film generally used as a gate insulating film must be formed on the amorphous carbon film, and then, the $SiO_2$ film must be selectively etched and patterned. At this time, the amorphous carbon film is also exposed to the etchant such as a buffered hydrofluoric acid solution and damaged by this etchant to a large extent.

Figure 15:
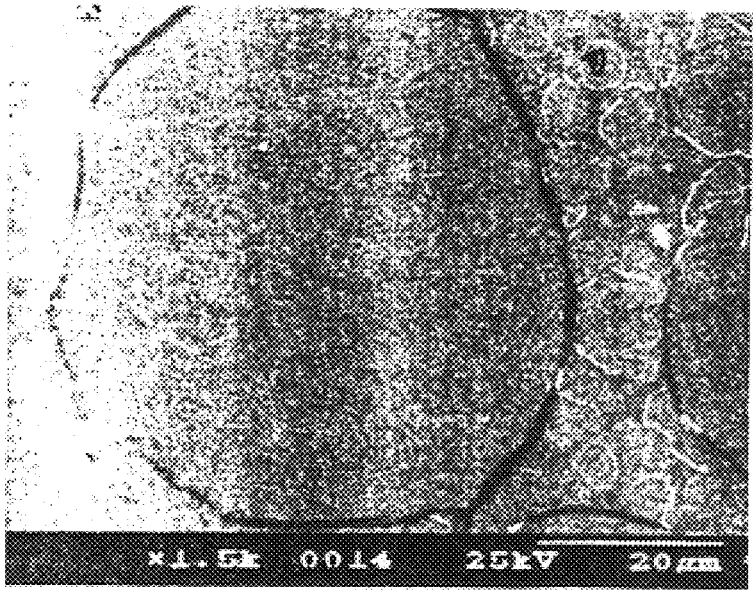
FIG. 15 is an SEM (Scanning Electron Microscope) photograph showing the surface of an nitrogen-doped amorphous carbon film after etching using buffered hydrofluoric acid.

FIG. 15 is an SEM (Scanning Electron Microscope) photograph showing the surface of the nitrogen-doped amorphous carbon film after etching using the buffered hydrofluoric acid solution. As shown in FIG. 15, the film surface has nonuniformly peeled upon etching.

The film with a graphite structure formed by the cathode arc method, disclosed in Jpn. Pat. Appln. KOKAI Publication No. 10-112253, has a formation wherein only fullerene-like microstructures have aggregated. That is, since the three-dimensional bonding force of the film structure is weak, a sufficient mechanical strength as an emitter material for a cold cathode device cannot be obtained. In addition, since the film surface is uniformly etched, projections for field emission can hardly be formed on the film surface.

However, when the cathode arc method is practiced under a specific condition, a film in which an appropriate number of fullerene-like microstructures are dispersed in nitrogen-doped amorphous carbon can be formed. This film exhibits more excellent characteristics of electron emission, mechanical strength, and fabrication than those of the film formed by the above prior art.

Embodiments of the present invention that are made on the basis of these findings will be described hereinafter with reference to the accompanying drawing. In the following description, the constituent elements having substantially the same function and arrangement are denoted by the same reference numerals, and a repetitive description will be made only when necessary.

Figure 1:
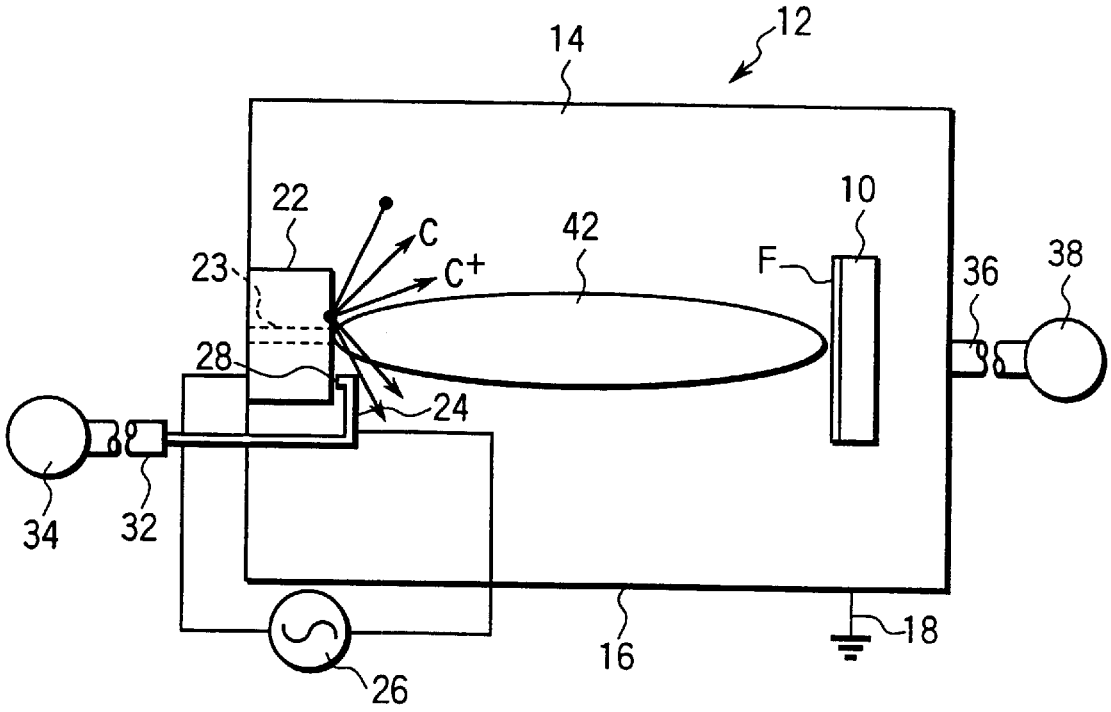
FIG. 1 is a schematic view showing a film forming apparatus for forming an electron emission film according to the present invention.

FIG. 1 is a schematic view showing a film forming apparatus 12 for forming an electron emission film of the present invention by differential pressure AC arc discharge.

The film forming apparatus 12 has a vacuum chamber 14 for accommodating a substrate 10 to be processed. The vacuum chamber 14 is constructed by a conductive casing 16 and grounded through a ground line 18. A carbon electrode 22 consisting of carbon is placed at one end in the vacuum chamber 14 to be separated from the position of the substrate 10 by several ten cm. A rod-shaped counter electrode 24 opposes the carbon electrode 22. The counter electrode 24 can be moved relative to the carbon electrode 22, so the distance between the electrodes 22 and 24 can be adjusted. An AC power supply 26 is arranged to apply a low-frequency AC power between the carbon electrode 22 and the conductive casing 16.

The counter electrode 24 is formed as a conduit having, at its distal end, an outlet port 28 with a diameter of about 1 mm, while a supply pipe 32 is connected to its proximal end. The supply pipe 32 is connected to a nitrogen gas source 34 through a switching valve and a flow rate adjustment valve (neither are shown). The outlet of the counter electrode 24, i.e., the nitrogen gas supply port 28 is set to blow nitrogen gas against the carbon electrode 22. Near the substrate 10, an exhaust pipe 36 is connected to the vacuum chamber 14. The exhaust pipe 36 is connected to an exhaust pump 38 through a switching valve and a flow rate adjustment valve (neither are shown). As indicated by the dotted line in FIG. 1, a gas supply path 23 may be connected to the carbon electrode 22 and used as a nitrogen gas supply nozzle.

In the film forming apparatus 12, a carbon plume 42 is formed from the discharge arc of the carbon electrode 22, and an electron emission film F according to the present invention is deposited on the process surface of the substrate 10. In the film forming process, the substrate 10 is put in the vacuum chamber 14, and the vacuum chamber 14 is set to a vacuum of, e.g., $2\times10^{-5}$ mbar, by the pump 38. Next, nitrogen gas is spouted from the supply port 28 while the vacuum chamber 14 is evacuated by the pump 38, and simultaneously, an AC power is applied between the electrodes 22 and 24 to cause arc discharge. With this process, the carbon plume 42 is formed to sublimate carbon from the carbon electrode 22, thereby depositing the electron emission film F on the process surface of the substrate 10.

According to the above-described method, the nitrogen gas pressure can be selectively made high at a portion where a discharge arc is generated. Generating an arc while raising the nitrogen gas pressure is effective in obtaining an active carbon plume containing nitrogen. On the other hand, such a high gas pressure is disadvantageous in forming a uniform and fine film. Since the exhaust port is formed behind the substrate 10, the pressure can be lowered near the substrate 10, so a fine and satisfactory electron emission film can be formed on the substrate 10. In the film forming process, the pressure on the substrate 10 is preferably set to be about $1\times10^{-4}$ to $1\times10^{-1}$ mbar and, more preferably, about $1\times10^{-3}$ to $1\times10^{-2}$ mbar.

In the above method, the AC power alternately sets a condition for depositing amorphous carbon on the substrate 10 and a condition for depositing fullerene-like microstructures on the substrate 10 by changing the input energy. Therefore, the AC power to be used in the film forming process must have a low frequency. The frequency is preferably set to be about 10 to 500 Hz and, more preferably, about 20 to 100 Hz.

EXAMPLE 1

A sample S of a conductive substrate with the electron emission film F of the present invention was formed using the film forming apparatus 12 shown in FIG. 1. The film forming conditions were as follows.

Material of substrate 10: $n^+$-type Si

Material of carbon electrode 22: graphite

Material of counter electrode 24: graphite

Temperature of substrate 10: room temperature

Distance between substrate 10 and carbon electrode 22: 25 cm

Pressure on substrate 10: $8\times10^{-3}$ mbar

Voltage of AC power: 22 to 24V

Frequency of AC power: 50 Hz

Figure 4A:
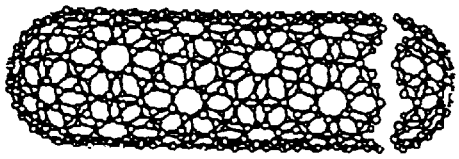
FIGS. 4A to 4C are views for explaining a fullerene.
Figure 4B:
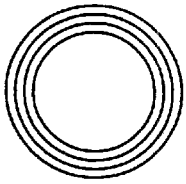
Figure 4C:
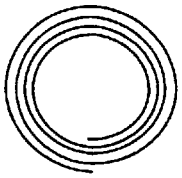
Figure 2:
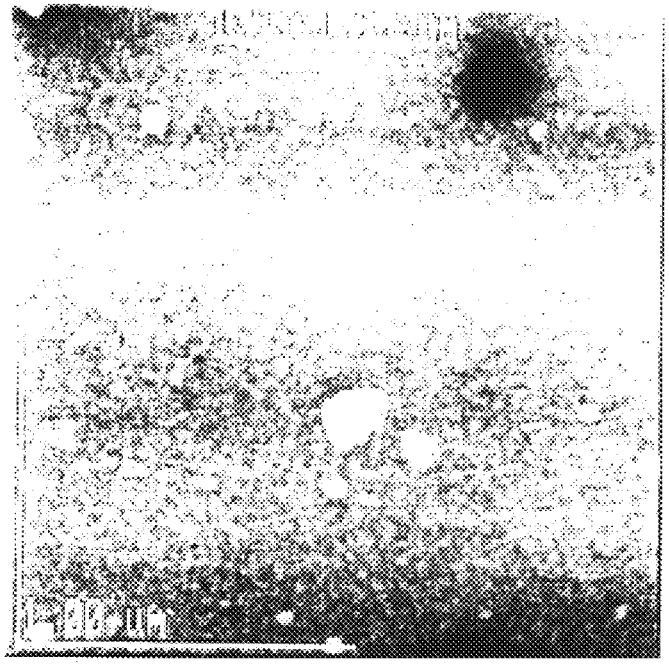
FIG. 2 is an AFM (Atomic Force Microscope) photograph showing the surface of an electron emission film obtained in the Example 1.
Figure 3:
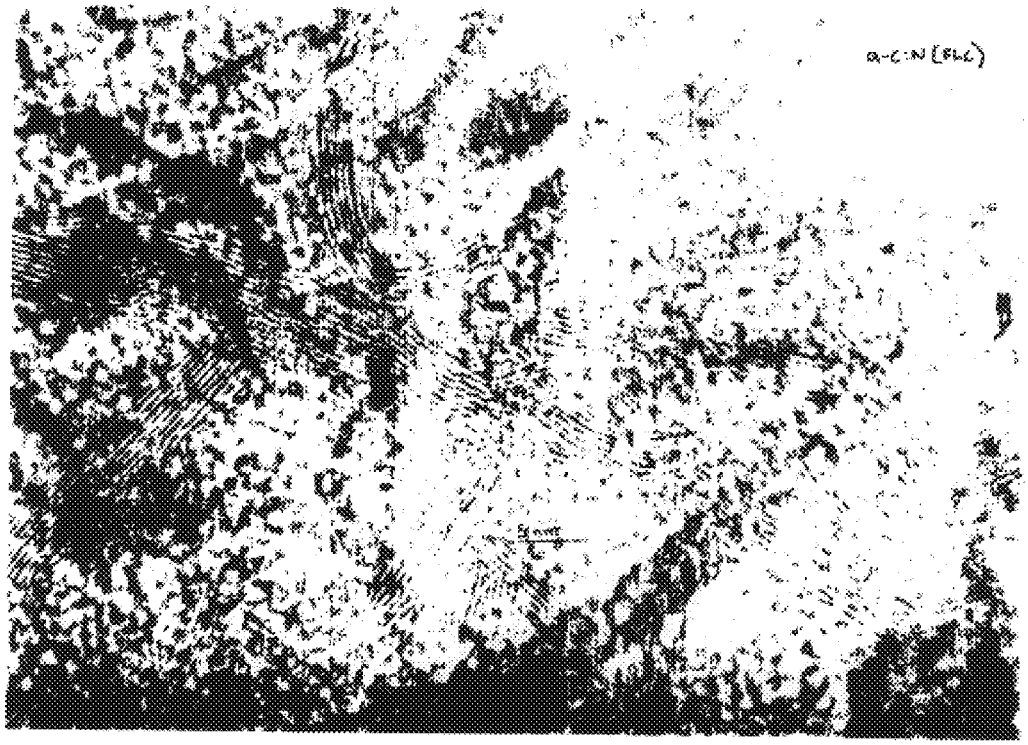
FIG. 3 is a TEM (Transmission Electron Microscope) photograph showing the microstructure on the surface of the electron emission film shown in FIG. 2.

FIG. 2 is an AFM (Atomic Force Microscope) photograph showing the surface of the electron emission film of the sample S obtained in the Example 1. As shown in FIG. 2, the film surface is smooth and uniform except particles which appear to have stuck to the film surface later. FIG. 3 is a TEM (Transmission Electron Microscope) photograph showing the microstructure on the surface of the electron emission film. As shown in FIG. 3, a high-density crystalline graphite structure or fullerene-like structure can be observed in the film. A number of regular concentric circles shown in FIG. 3 correspond to sections shown in FIGS. 4B and 4C.

Figure 5:
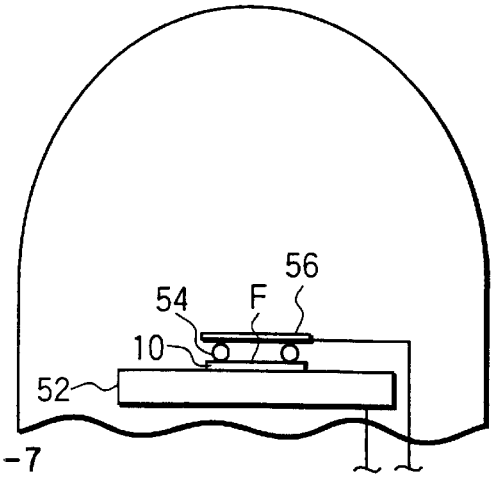
FIG. 5 is a view for explaining measurement of the electric-field/electron-emission characteristics of the electron emission film.
Figure 6:
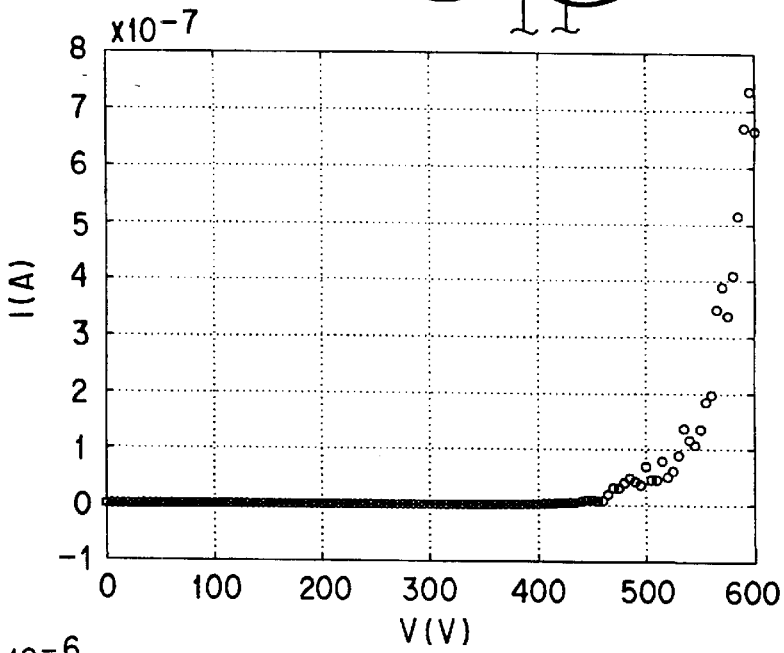
FIG. 6 is a graph showing the electric-field/electron-emission characteristics of the electron emission film shown in FIG. 2.
Figure 7:
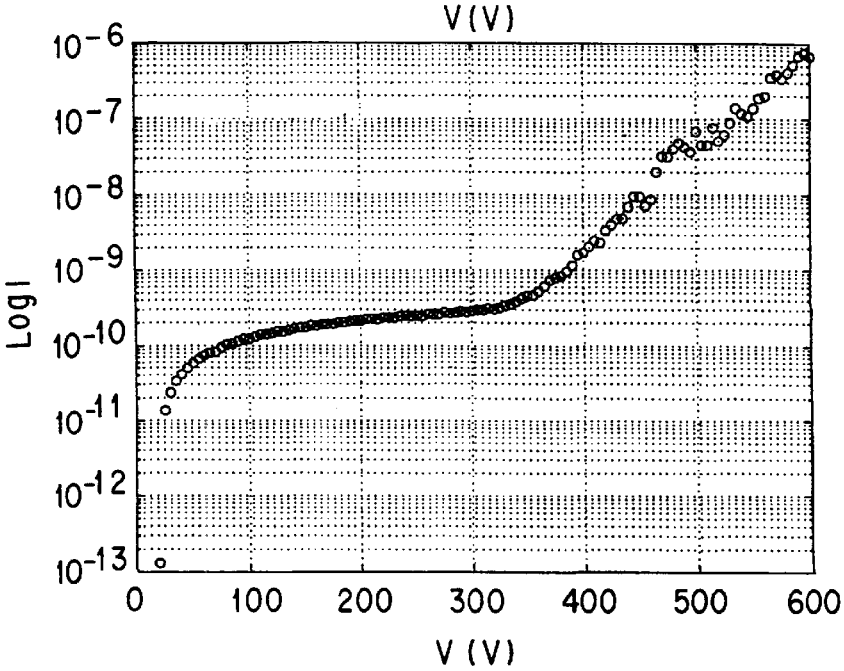
FIG. 7 is a graph obtained by rewriting the graph shown in FIG. 6 on the log scale.

Directly using the conductive substrate 10 of the sample S as a cathode electrode, the electric-field/electron-emission characteristics of the electron emission film F were measured in the manner shown in FIG. 5. In measurement, the substrate 10 was mounted on an Al slab 52, an anode plate 56 (ITO or Al strip glass) was set to oppose the electron emission film F via a spacer 54 (glass fiber), and a voltage was applied between electrodes 10 and 12 in a vacuum. The diameter of the spacer was about 70 $\mu$m, and the degree of the vacuum was $1\times10^{-7}$ Torr. FIGS. 6 and 7 are graphs showing the electric-field/electron-emission characteristics of the electron emission film F, which were obtained by this measurement. As shown in FIGS. 6 and 7, an increase in current was observed from around 320V, and electron emission at a low electric field was confirmed.

Figure 8:
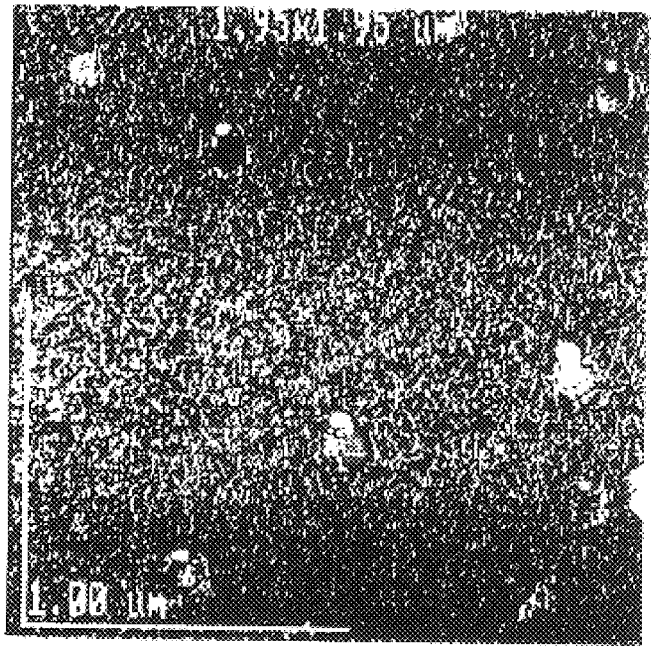
FIG. 8 is an AFM photograph showing the surface of an electron emission film after etching using buffered hydrofluoric acid.

The electron emission film F was dipped in a buffered hydrofluoric acid solution for 10 min to etch the surface. FIG. 8 is an AFM photograph showing the surface of the electron emission film F after etching using buffered hydrofluoric acid. As shown in FIG. 8, the electron emission film F of the present invention had no damage such as peeling, unlike the film made of only nitrogen-doped amorphous carbon (FIG. 15). Microscopically, however, a fine pattern did form on the film surface.

Figure 9:
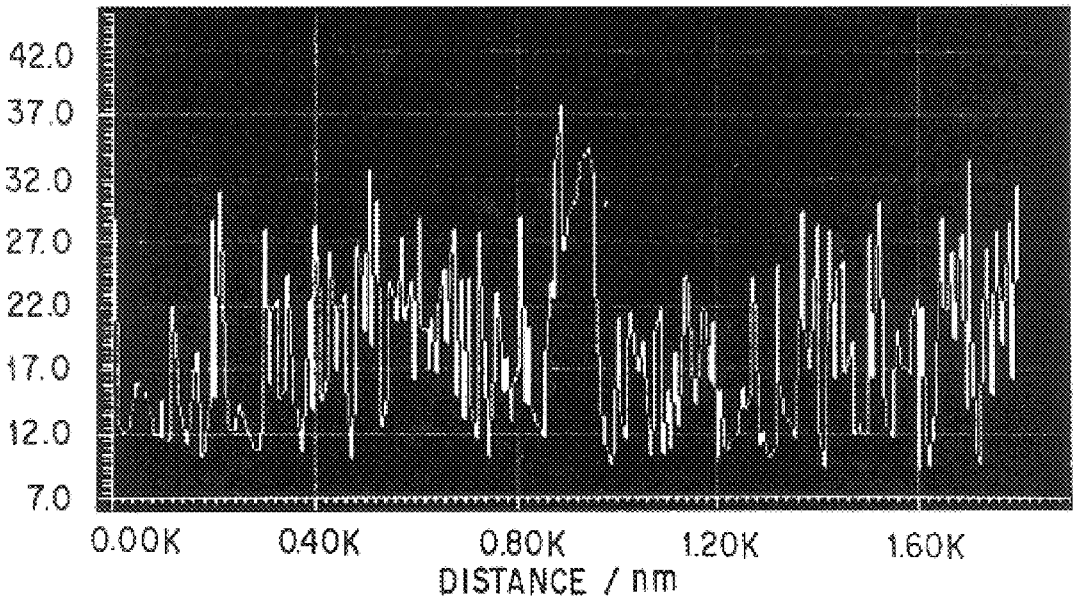
FIG. 9 is a graph showing the AFM observation result of the sectional profile of the surface of the electron emission film shown in FIG. 8.
Figure 10:
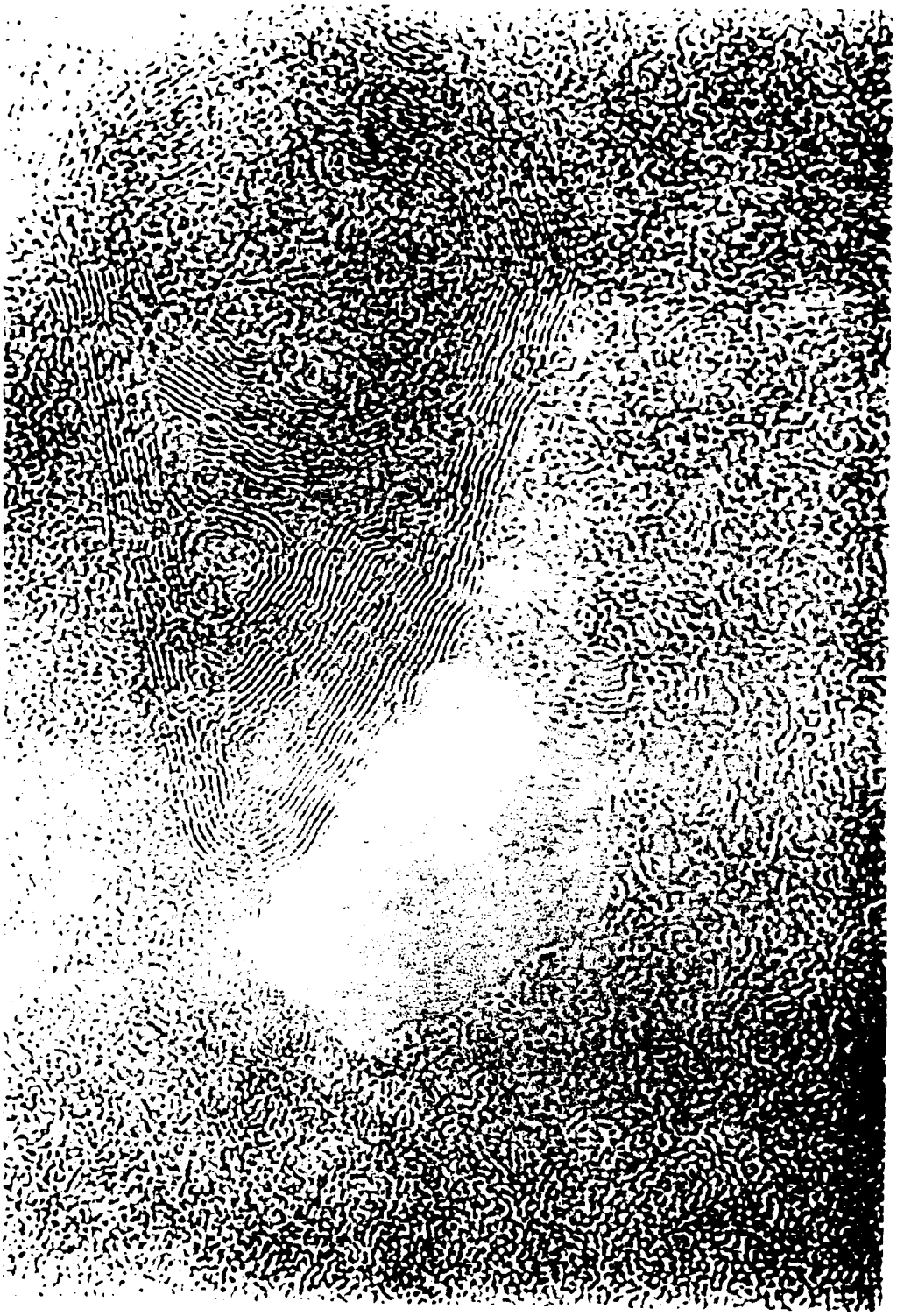
FIG. 10 is a TEM photograph showing the microstructure on the surface of the electron emission film shown in FIG. 8.

FIG. 9 is a graph showing the AFM observation result of the sectional profile of the surface of the electron emission film F after etching using buffered hydrofluoric acid. FIG. 10 is a TEM photograph showing the microstructure on the surface of the electron emission film F after etching. As shown in FIGS. 9 and 10, the fine pattern on the surface of the electron emission film F was formed from very small and sharp projecting portions. A closer look at the microstructure of this film revealed that walls with a fullerene-like structure remained to project from the matrix of the film, sandwiching grooves.

From the above experiments, the following estimation can be made about the electron emission film F. The matrix of the electron emission film F consists of nitrogen-doped amorphous carbon which is readily etched by the buffered hydrofluoric acid solution. Normally, the fullerene-like structures dispersed in the matrix rarely contain nitrogen atoms. Since the electron emission film F has this structure, the matrix is preferentially etched upon etching, and the fullerene-like structures are left to project from the matrix.

Figure 11:
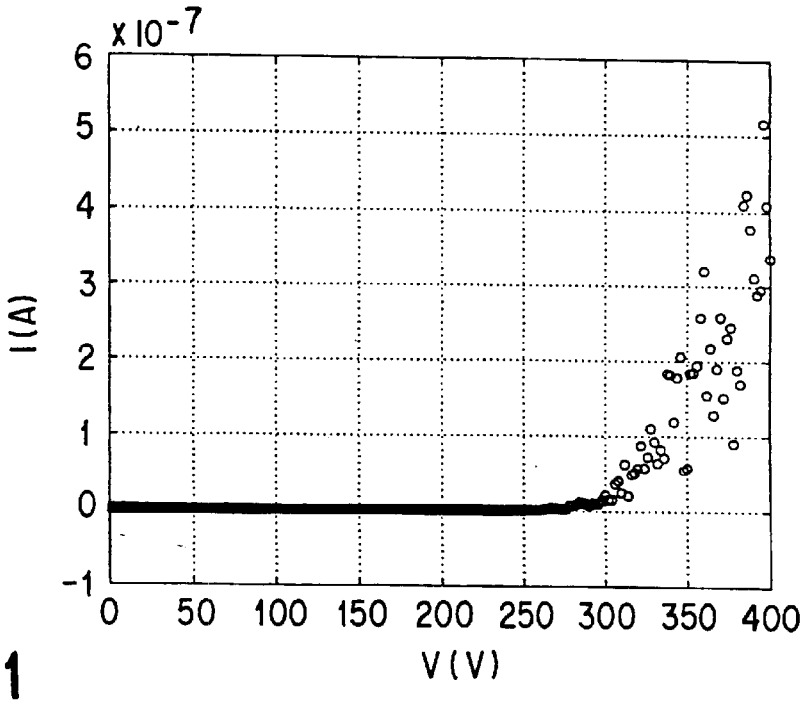
FIG. 11 is a graph showing the electric-field/electron-emission characteristics of the electron emission film shown in FIG. 8.
Figure 12:
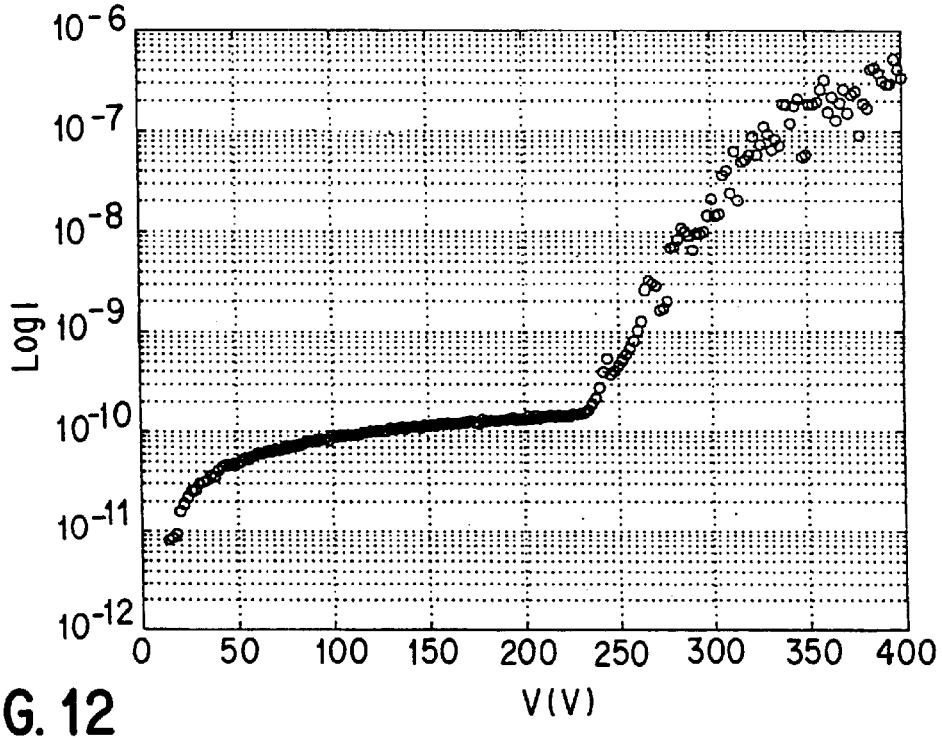
FIG. 12 is a graph obtained by rewriting the graph shown in FIG. 11 on the log scale.

The electric-field/electron-emission characteristics of the electron emission film F etched using buffered hydrofluoric acid were also measured in the manner shown in FIG. 5. The measurement conditions are the same as those of the above measurement whose result is shown in FIGS. 6 and 7. FIGS. 11 and 12 shows the electric-field/electron-emission characteristics of the electron emission film F, which were obtained by this measurement. As shown in FIGS. 11 and 12, an increase in current was observed from around 230V, i.e., a lower voltage than in the result shown in FIGS. 6 and 7. The current rise was steeper. Perhaps, this voltage lowering occurs due to higher electric field concentration because fine edges of the fullerene-like structures project from the film surface.

In the electron emission film of the present invention, the ratio of nitrogen-doped amorphous carbon, which forms the matrix, and fullerene-like structures, i.e., crystal structures consisting essentially of a two-dimensional network of six-membered carbon rings, is an important factor in defining the electron emission, mechanical strength, and fabrication characteristics of the film.

Figure 16:
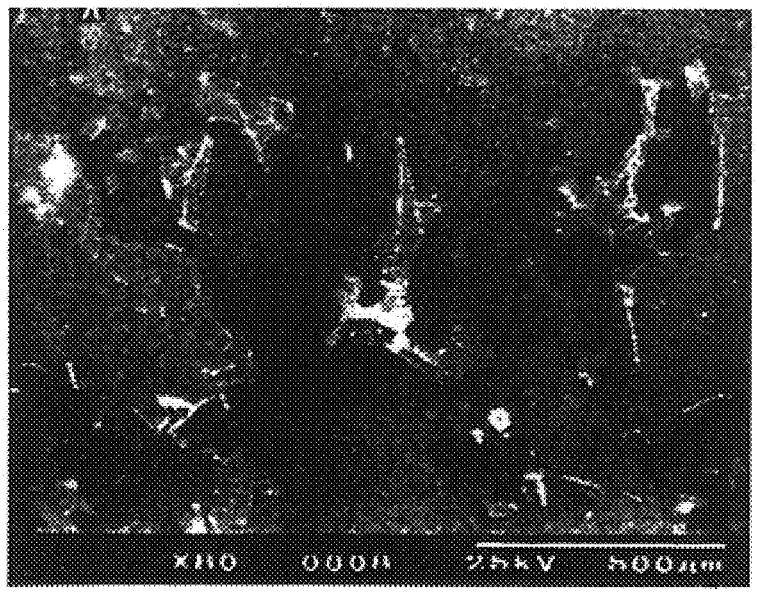
FIG. 16 is an SEM photograph showing the surface of an nitrogen-doped amorphous carbon film having fullerene-like structures at a low concentration after etching using buffered hydrofluoric acid.

If the ratio of nitrogen-doped amorphous carbon is too high, damage to the film upon etching becomes large. FIG. 16 is an SEM photograph showing the surface of an nitrogen-doped amorphous carbon film having fullerene-like structures at a low concentration after etching using the buffered hydrofluoric acid solution. As shown in FIG. 16, the film surface is damaged, i.e., has nonuniformly peeled upon etching. In addition, when the ratio of nitrogen-doped amorphous carbon is too high, the fullerene-like structures projecting from the matrix decrease to degrade the electron emission characteristics of the film.

Conversely, when the ratio of fullerene-like structures is too high, the three-dimensional bonding force of the film structure is weak, and the mechanical strength becomes insufficient. In addition, since the film surface is uniformly etched, a three-dimensional pattern for field emisssion can hardly be formed on the film surface.

From the foregoing, the film forming condition is preferably set such that the weight ratio of nitrogen-doped amorphous carbon to fullerene-like structures is about 50:50 to 5:95 and, more preferably about 40:60 to 20:80.

In the electron emission film according to the present invention, the concentration of nitrogen in nitrogen-doped amorphous carbon for forming the matrix is also an important factor in defining the electron emission, mechanical strength, and fabrication characteristics of the film.

If the nitrogen concentration in amorphous carbon is too low, the resistivity of the matrix becomes high to degrade the electron emission characteristics of the film. In addition, since the etching selectivity for the fullerene-like structures lowers, a three-dimensional pattern for field emission can hardly be formed on the film surface.

From the above viewpoint, the film forming condition is preferably set such that the concentration of nitrogen in nitrogen-doped amorphous carbon is about $4\times10^{-7}$ to 10 atom % ($1\times10^{15}$ to $1.5\times10^{22}$ $cm^{-3}$) and, more preferably, about $4\times10^{-2}$ atom % ($1\times10^{20}$ $cm^{-3}$).

The impurity to be doped to amorphous carbon is not limited to nitrogen. For example, when an impurity such as phosphorus which acts as a donor for amorphous carbon is used, the resistivity of the matrix can be lowered, and the etching selectivity can be improved. As the etchant for selectively etching amorphous carbon with respect to the fullerene-like structures, another etchant such as oxygen plasma can be used in place of the hydrofluoric acid solution.

Figure 13A:
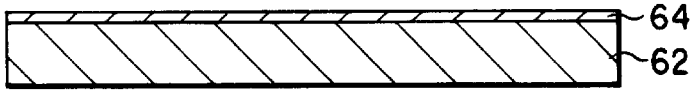
FIGS. 13A to 13C are sectional views showing steps in the manufacture of a field emission cold cathode device using the electron emission film of the present invention.
Figure 13B:
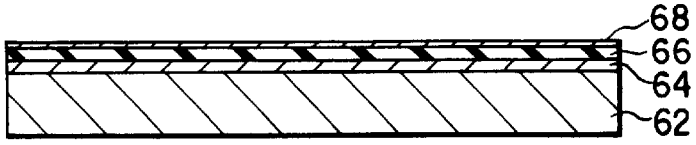
Figure 13C:
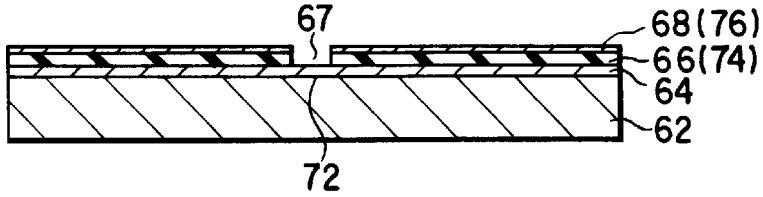

FIGS. 13A to 13C are sectional views showing steps in the manufacture of a field emission cold cathode device using the electron emission film of the present invention.

A field emission film 64 according to the present invention is formed on an $n^+$-type Si substrate 62 using the film forming apparatus 12 shown in FIG. 1 under the conditions of the Example 1 (FIG. 13A). An Si oxide film 66 and a gate metal film 68 are formed on the field emission film 64 (FIG. 13B). The metal film 68 is patterned by the conventional PEP (Photolithography Etching Process) to form a hole 67 in which the Si oxide film 66 is exposed. Next, the Si oxide film 66 is etched using a buffered hydrofluoric acid solution and the metal film 68 as a mask to expose the surface of the electron emission film 64 (FIG. 13C). At this time, the surface of the electron emission film 64 is etched by the buffered hydrofluoric acid solution, as described above.

In the resultant field emission cold cathode device, that portion of the electron emission film 64, which is exposed in the hole 67 of a gate insulating film 74 formed from the Si oxide film 66, functions as an emitter 72. That is, the emitter 72 has an electron emission surface made of the electron emission film 64. A gate electrode 76 formed from the metal film 68 on the gate insulating film 74 has an edge portion surrounding the emitter 72 and functions as an extraction electrode. The substrate 62 functions not only as a support substrate but also as a cathode electrode.

FIGS. 14A to 14D are sectional views showing steps in the manufacture of another field emission cold cathode device using the electron emission film of the present invention. This manufacturing method uses a so-called transfer mold method.

Figure 14A:
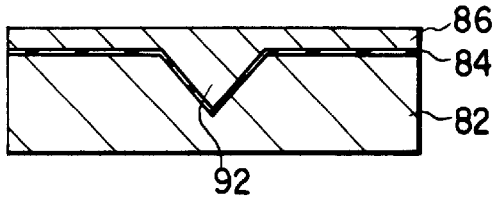
FIGS. 14A to 14D are sectional views showing steps in the manufacture of another field emission cold cathode device using the electron emission film of the present invention.
Figure 14B:
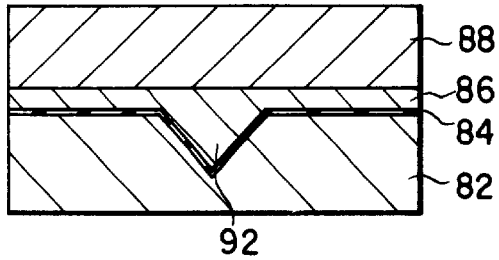
Figure 14C:
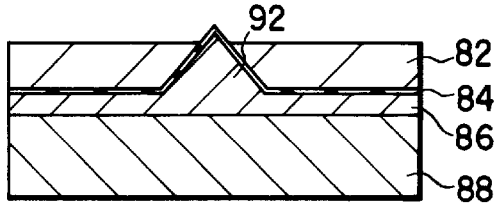
Figure 14D:
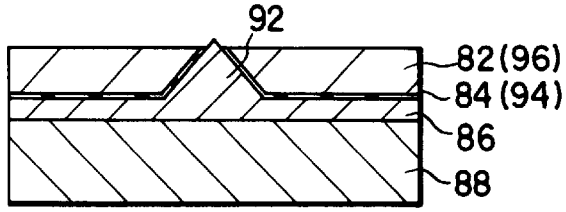

First, a mold is formed on an $n^+$-type Si substrate 82 by anisotropic etching and thermally oxidized to form an Si oxide film 84. A field emission film 86 according to the present invention is formed on the Si oxide film 84 using the film forming apparatus 12 shown in FIG. 1 under the conditions of the Example 1 (FIG. 14A). With this process, a pyramidal emitter 92 is formed from the field emission film 86 in the mold. A conductive substrate 88 is bonded to the field emission film 86 via a conductive layer (not shown) (FIG. 14B). The mold substrate 82 is etched to expose the distal end of the pyramidal emitter 92 covered with the Si oxide film 84 (FIG. 14C). The Si oxide film 84 is etched using the buffered hydrofluoric acid solution and the mold substrate 82 as a mask to expose the surface of the field emission film 86 positioned at the distal end of the emitter 92 (FIG. 14D). At this time, the surface of the electron emission film 86 is etched by the buffered hydrofluoric acid solution, as described above.

In the resultant field emission cold cathode device, the Si oxide film 84 and the mold substrate 82 function as a gate insulating film 94 and a gate electrode 96, respectively. The conductive substrate 88 functions not only as a support substrate but also as a cathode electrode. The distal end of the pyramidal emitter 92 formed from the electron emission film 86 is exposed from an opening formed in the gate insulating film 94 and the gate electrode 96. That is, the emitter 92 has an electron emission surface formed from the electron emission film 86. The device shown in FIG. 14D has an emitter 92 with a sharp point and therefore obtains more satisfactory electric-field/electron-emission characteristics than those of the device shown in FIG. 13C.

The electron emission film of the present invention can withstand etching using a buffered hydrofluoric acid solution or the like, which is necessary in the process of manufacturing a semiconductor device. This allows flexible device design. In addition, since the corrosion resistance and mechanical strength of the film itself are high, damage such as corrosion or peeling under the normal use atmosphere rarely occurs, so degradation in service life or performance of the device can be suppressed. Furthermore, the degree of field concentration on the electron emission surface of the film can be increased by etching, so electron emission at a lower electric field can be realized.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electron emission film comprising:

a first portion which consists essentially of amorphous carbon and forms a matrix; and a second portion having a crystal structure which consists essentially of a two-dimensional network of six-membered carbon rings that are dispersed in said matrix and partially project from said matrix, wherein a weight ratio of said first portion to said second portion is about 50:50 to 5:95, and said first portion contains an impurity acting as a donor.

2. The film according to claim 1, wherein said impurity is contained at a concentration of about $4\times10^{-7}$ to 10 atom %.

3. The film according to claim 1, wherein said impurity is nitrogen.

4. A method of manufacturing said electron emission film of claim 3, using a film forming apparatus, said film forming apparatus comprising a vacuum chamber for accommodating a substrate to be processed, a carbon electrode and a counter electrode which are placed in said vacuum chamber to oppose each other, a power supply for applying an AC power having a low frequency between said electrodes, and a supply port for supplying nitrogen to an area near said carbon electrode, and said method comprising:

a preparation step of placing said substrate in said vacuum chamber and setting said vacuum chamber to a vacuum; and a film forming step of supplying nitrogen from said supply port and applying said AC power between said electrodes, to generate arc discharge and sublimate carbon from said carbon electrode, thereby depositing said electron emission film on said substrate.

5. The method according to claim 4, wherein said frequency of said AC power is set to be about 10 to 500 Hz, in said film forming step.

6. The method according to claim 4, wherein said vacuum chamber is evacuated from an exhaust port located to be closer to said substrate than said counter electrode, in said film forming step.

7. The method according to claim 4, wherein a pressure on said substrate is set to be about $1\times10^{-4}$ to $1\times10^{-1}$ mbar.

8. The method according to claim 4, further comprising, after said film forming step, a step of etching a surface of said electron emission film using an etchant for preferentially etching said first portion relative to said second portion.

9. The method according to claim 8, wherein said etchant is a solution containing hydrofluoric acid.

10. A field emission cold cathode device comprising:

a support substrate;

an emitter arranged on said support substrate, said emitter having an electron emission surface formed of an electron emission film; and an extraction electrode for extracting electrons from said emitter, wherein said electron emission film comprises a first portion which consists essentially of amorphous carbon and forms a matrix, and a second portion having a crystal structure which consists essentially of a two-dimensional network of six-membered carbon rings that are dispersed in said matrix and partially project from said matrix, wherein a weight ratio of said first portion to said second portion is about 50:50 to 5:95, and said first portion contains an impurity acting as a donor.

11. The device according to claim 10, wherein said impurity is contained at a concentration of about $4\times10^{-7}$ to 10 atom %.

12. The device according to claim 10, wherein said extraction electrode is formed of a gate electrode supported by said support substrate via a gate insulating film and opposing said emitter, and said gate insulating film consists essentially of silicon oxide.

13. A method of manufacturing said field emission cold cathode device of claim 12, comprising the steps of:

forming a multilayered structure having said support substrate, said electron emission film, a silicon oxide film to be said gate insulating film, and a conductive film to be said gate electrode, stacked in this order;

partially removing said conductive film in correspondence with said emitter to expose a selected portion of said silicon oxide film; and etching said selected portion of said silicon oxide film using an etchant to expose said electron emission surface of said emitter and simultaneously etching said electron emission surface using said etchant, said etchant preferentially etching said first portion relative to said second portion of said electron emission film.

14. The method according to claim 13, wherein said etchant is a solution containing hydrofluoric acid.

* * * * *